United States Patent [19]

Dubner et al.

[11] Patent Number: 5,016,917

[45] Date of Patent: May 21, 1991

[54] REGIMEN CALENDAR

[76] Inventors: Daniel W. Dubner, 46 Dalton Rd., Chelmsford, Mass. 01824; D. Gregory Felch, 350 Stearns St., Carlisle, Mass. 01741

[21] Appl. No.: 465,462

[22] Filed: Jan. 16, 1990

[51] Int. Cl.[5] ..... B42D 5/04

[52] U.S. Cl. ..... 283/4; 283/2; 40/119

[58] Field of Search ..... 283/2, 3, 4; 40/107, 40/119

[56] References Cited

U.S. PATENT DOCUMENTS

| | | | |
|---|---|---|---|
| 1,536,429 | 5/1925 | Ferdon | 283/2 |
| 2,354,589 | 7/1944 | Georgi | 283/2 |
| 4,201,405 | 5/1980 | Rannenberg | 283/4 |
| 4,757,624 | 7/1988 | Holec | 40/119 |
| 4,798,402 | 1/1989 | Pazioni | 40/119 |

FOREIGN PATENT DOCUMENTS

| | | | |
|---|---|---|---|
| 1501853 | 11/1967 | France | 283/4 |
| 2390296 | 1/1979 | France | 283/4 |

*Primary Examiner*—Frank T. Yost
*Assistant Examiner*—Hwei-Siu Payer
*Attorney, Agent, or Firm*—Wolf, Greenfield & Sacks

[57] ABSTRACT

A regimen calendar is provided which permits the correlating of time periods of a predetermined regimen with the calendar time periods in which such regimen is being performed. The calendar has a plurality of first pages or other media on which information concerning the regimen for a given time period may be recorded and a plurality of second sequentially arranged pages or other media containing indicia of selected calendar time periods. The first and second pages are mounted such that one of the first pages and one of the second pages are being displayed, and that the first and second pages may be independently changed so that any first page may be displayed with any second page. More of the second pages are provided than the first pages, permitting the regimen to commence at a calendar time period later than the earliest calendar time period for which there is a second page, with correlation between the first and second pages still being possible for the regimen time periods represented by the first pages.

12 Claims, 2 Drawing Sheets

REGIMEN CALENDAR

FIELD OF THE INVENTION

This invention relates to regimen calendars and more particularly to a calendar for correlating the time periods of a predetermined regimen with the calendar time periods in which such regimen is being performed.

BACKGROUND OF THE INVENTION

There are many situations where one or more individuals are to engage in a particular regimen during a particular time period. Such situations may include, for example, a training schedule for a marathon or other athletic event, a diet to gain or lose weight, procedures to be followed during a particular time period, for example the first year of a child's life, the regimen to be followed during pregnancy, and the like.

When performing such a regimen, it is desirable that the individual be able to correlate the time periods, for example weeks or months, during which such regimen is being performed with calendar time periods on some type of regimen calendar, and that a facility be provided for recording actual progress and other significant events concerning the regimen on the calendar so that progress on the regimen may be compared against the desired progress or procedures for the regimen. However, since most calendars begin at the beginning of a year while a particular regimen may begin at any time during a year, a regimen calendar providing this correlation capability is not easily achieved and does not currently exist.

Thus, a need exists for an improved regimen calendar which permits time periods for the regimen to be performed to be correlated with calendar time periods, while permitting progress against the regimen to be recorded with the calendar time periods.

SUMMARY OF THE INVENTION

In accordance with the above, this invention provides a calendar for correlating the time periods of a predetermined regimen with the calendar time periods in which such regimen is being performed. The calendar has a plurality of sequentially arranged first means, which for example may be pages or other media on which information may be recorded, each of which first means contain information concerning the regimen for a given one of the time periods. A plurality of sequentially arranged second means are also provided, each of which second means may also be a page or other media on which information may be recorded. Each of the second means contains indicia of a selected calendar time period. The second means also preferably contains space for permitting progress against the regimen to be recorded at a place corresponding to the time at which the event occurs. The calendar further contains means for mounting the first and second means such that one of the first means and one of the second means are displayed and that the first and second means being displayed may be independently changed so that any first means may be displayed with any second means. The predetermined time periods for each of the first and second means are preferably months or weeks, and the means for mounting preferably includes means for binding said first means and said second means. Front and back covers may be provided which cover the first and second means and are bound therewith. There are preferably more of the second means than the first means, permitting the regimen to commence at a calendar time period later than the earliest calendar time period for which there is a second means, with correlation between the first and second means still being possible through the regimen time periods represented by the first means. The regimen may be a diet, training schedule, child care schedule during a predetermined time period, such as the first or other year of a child's life, or pregnancy.

The foregoing other objects, features and advantages of the invention will be apparent from the following more particular description of a preferred embodiment of the invention as illustrated in the accompanying drawing.

In The Drawing

DETAILED DESCRIPTION

Figure 1:
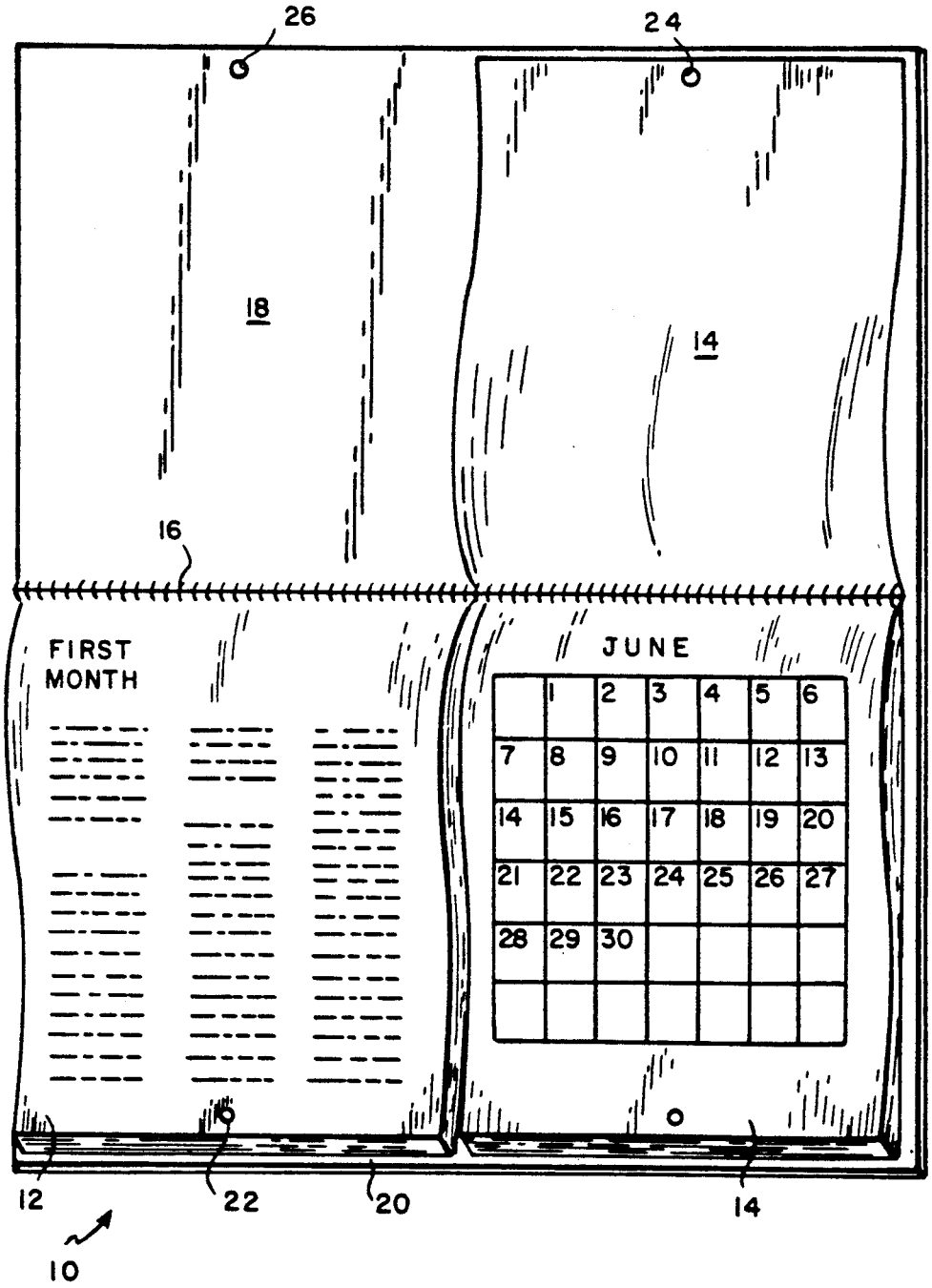
FIG. 1 is a front top perspective view of a regimen calendar of a preferred embodiment of the invention.

Referring to FIG. 1, a regimen calendar 10 is shown which includes a plurality of first pages 12 and a plurality of second pages 14. The pages 12 and 14 may be of paper, plastic or other material which may be printed and written on. The pages 12 and 14 ar bound with a wire spiral 16. In the figure, a single wire spiral 16 is shown on which both pages 12 and 14 are bound, although it is apparent that separate wire spirals could be provided for each set of pages. A front cover 18 and rear cover 20 are also bound on spiral 16. At least one mounting hole 22 is provided through each of the pages 12 and at least one mounting hole 24 is provided through each of the pages 14. Corresponding mounting holes 26 are also provided in front cover 18.

Pages 12 contain information relating to a predetermined regimen, each page for example containing the portion of the regimen which is to be performed or will occur during a predetermined time period of the regimen, for example a particular week or month thereof. Thus, in the figure, the page 12 being displayed is the page for the first month of the regimen. The pages 12 are preferably sequentially arranged and may contain additional information relevant to the particular regimen such as inspirational sayings to urge the participant along or the like.

Figure 2:
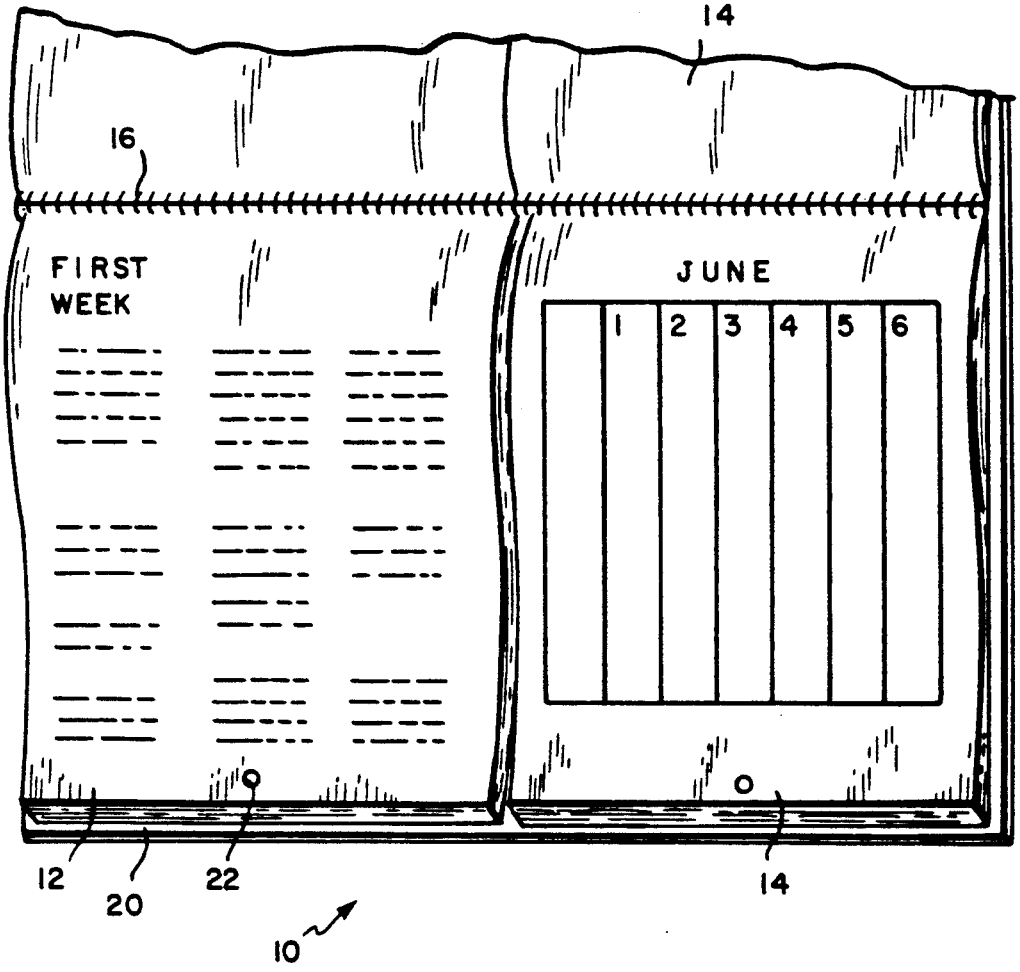
FIG. 2 is a partial front top perspective view of a regimen calendar of a second embodiment of the invention.

Each page 14 contains indicia relevant to a particular calendar time period, for example a calendar week or month during a particular year. FIG. 1 shows a regimen calendar where the time period for each page 14 is one month and the time period for each regimen page 12 is also preferably one month. Similarly, FIG. 2 shows a regimen calendar where the time period for each of the pages 14 is one week and the time period for the pages 12 are also preferably one week. Thus, the displayed page 14 in the figure is for the month June, 1990. The pages 14, which are preferably sequentially arranged, may also contain information as to events which occurred on a particular day or will occur on a particular day which are relevant to the regimen, for example dates when marathons are being held, and the pages 14 also provide space adjacent each day on which the individual performing the regimen may record progress or other significant events. For example, if the calendar is being used with respect to the first year of a child's life, the baby's weight and height at various dates may be recorded on pages 14 as well as dates when the baby speaks its first words, starts to crawl, takes its first steps, or sleeps through its first night. If the calendar is being used for a diet regimen, the participant may record his or her weight adjacent the appropriate dates on pages 14 when each weigh-in occurs. The calendar 10 thus provides a ready reference of progress on the regimen against a standard indicated on pages 12. The pages 14 may also contain additional information relevant to the regimen either in addition to or instead of the same type of information appearing on the pages 12. Additional relevant information may also be printed on the backs of pages 12 and/or 14, or decorative material such as pictures, photographs or the like may appear on the backs.

One problem with a regimen calendar of the type described above is that the regimen may start at any time during a calendar year. Therefore, to permit, the calendar to be used regardless of when during a calendar year the regimen begins, the pages 12 and 14 are independently mounted so that they may be changed independent of each other. Preferably more pages 14 are provided then pages 12 or, if the same number of pages are provided, only some of the pages 12 relate to the regimen, while the remaining pages contain additional information relevant to the regimen but not relating to schedule. For example, the additional pages may contain an appendix which is preferably tabbed and might contain, for example, for a baby's first year calendar, growth charts, development landmarks, first aid, babysitter's checklist, and the like. By providing more calendar pages 14 than there are regiment time period pages 12, the calendar time period at which a regimen begins may be correlated with the beginning of the regimen, while still permitting the calendar to be used for the entire duration of the regimen. Thus, if the calendar is to be made available only once a year, their might be 24 pages 14 for a one year regimen, so that, for example, if the regimen were to begin in Jun. 1990, as shown in the figure, pages would be available through May 1991 to permit the calendar to be used through the completion of the regimen. If new calendars were made available at six month intervals, then only 18 months of pages 14 would be required to permit a one year regimen to be completed.

Calendar 10 could be mounted to a wall by passing nails, hooks or the like attached to the wall through holes 22 and 24. Similarly, the calendar could be mounted to a refrigerator or other metal surface by passing magnet-back hooks through the holes. A mounting bracket could also be provided with the calendar with projecting pins or hooks spaced to pass through holes 22 and 24, with a magnet behind the bracket and/or holes in the bracket so that the bracket and the calendar mounted thereto might be attached to a refrigerator or other metal object and/or to a wall.

While for the preferred embodiment the pages 12 and 14 and covers 18 and 20 have been shown as being spiral bound, it is apparent that these pages and covers could be bound using other suitable means. Other suitable means could be provided in lieu of holes 22 and 24 for mounting calendar 10. Thus, while the invention has been particularly shown and described above with reference to a preferred embodiment, the foregoing and other changes in form and detail may be made therein by one skilled in the art without departing from the spirit and scope of the invention.

What is claimed is:

1. A calendar for correlating time periods of a predetermined regimen with calendar time periods in which the predetermined regimen is being performed comprising:

a plurality of sequentially arranged first means, each of which contains information concerning the regimen for a given time period;

a plurality of sequentially arranged second means, each of which contains indicia of a selected calendar time period; and means for mounting said first and second means such that one of said first means and one of said second means is displayed side by side and that the first and second means being displayed may be independently changed so that any first means may be displayed with any second means;

there being more calendar time periods for said second means than said first means, whereby said regimen may commence at a calendar time period later than the earliest calendar time period for which there is a second means, with correlation between the first and second means still being possible through the regimen time periods represented by the first means.

2. A calendar as claimed in claim 1 wherein there is a second means and at least one first means for each calendar month of the regimen.

3. A calendar as claimed in claim 1 wherein there is a second means and at least one first means for each calendar week of the regimen.

4. A calendar as claimed in claim 1 wherein each of said first means and each of said second means is a page; and wherein said means for mounting includes means for binding the pages of said first means the pages of said second means.

5. A calendar as claimed in claim 4 wherein said pages are spiral bound.

6. A calendar as claimed in claim 4 including a front cover and a back cover, said front and back covers covering the pages of both said first and second means, said covers being bound with said first and second means.

7. A calendar as claimed in claim 1 wherein said calendar is for the regimen for a predetermined time period wherein there is at least one first means for each selected calendar time period of said predetermined time period; and wherein the number of said second means is sufficient so that there will be a second means for each calendar time period during the full predetermined time period regardless of the calendar time period during which the regimen commences.

8. A calendar as claimed in claim 7 wherein said predetermined time period is one year;

wherein said calendar is published N times during a calendar year; and wherein the number of said second means is at least equal to $(12+12/N)$.

9. A calendar as claimed in claim 1 wherein said regimen relates to pregnancy.

10. A calendar as claimed in claim 1 including means for mounting the calendar.

11. A calendar as claimed in claim 10 wherein said means for mounting the calendar includes at least one hole passing through each of said first and second means.

12. A calendar as claimed in claim 1 including space provided adjacent the time period indicia of said second means for recording events relating to the performance of the region.

* * * * *